US009796101B2

(12) United States Patent
Haba

(10) Patent No.: US 9,796,101 B2
(45) Date of Patent: Oct. 24, 2017

(54) RAZOR

(71) Applicant: KAI R&D Center Co., Ltd., Seki-shi (JP)

(72) Inventor: Daisuke Haba, Seki (JP)

(73) Assignee: KAI R & D Center Co., Ltd. (JP)

( * ) Notice: Subject to any disclaimer, the term of this patent is extended or adjusted under 35 U.S.C. 154(b) by 163 days.

(21) Appl. No.: 14/439,066

(22) PCT Filed: Nov. 5, 2013

(86) PCT No.: PCT/JP2013/079813
§ 371 (c)(1),
(2) Date: Apr. 28, 2015

(87) PCT Pub. No.: WO2014/073500
PCT Pub. Date: May 15, 2014

(65) Prior Publication Data

US 2015/0290822 A1 Oct. 15, 2015

(30) Foreign Application Priority Data

Nov. 6, 2012 (JP) ..... 2012-244029

(51) Int. Cl.
*B26B 21/52* (2006.01)
*B26B 21/22* (2006.01)
*B26B 21/40* (2006.01)

(52) U.S. Cl.
CPC ..... *B26B 21/521* (2013.01); *B26B 21/225* (2013.01); *B26B 21/4037* (2013.01); *B26B 21/522* (2013.01)

(58) Field of Classification Search
CPC . B26B 21/225; B26B 21/4037; B26B 21/522; B26B 21/521
See application file for complete search history.

(56) References Cited

U.S. PATENT DOCUMENTS 4,152,828 A 5/1979 Lund
5,031,319 A * 7/1991 Althaus ..... B26B 21/522 30/526

(Continued)

FOREIGN PATENT DOCUMENTS

CN 2393695 Y 8/2000
CN 1447736 A 10/2003

(Continued)

OTHER PUBLICATIONS

Chinese Office Action for Application No. 201380056966.0 dated Nov. 4, 2015.

(Continued)

*Primary Examiner* — Hwei C Payer
(74) *Attorney, Agent, or Firm* — Tarolli, Sundheim, Covell & Tummino LLP

(57) ABSTRACT

A top portion extends from an upper end of a handle. The top portion is curved from the front to the back. A clearance is located between the back side of the razor head and the front of the top portion of the holder. The clearance between the back side of the razor head and the front of the top portion is changed by means of a pivoting mechanism such that, when the razor head is at the neutral position, the clearance at a position separated from the cutting edge is greater than the clearance at a position in the vicinity of the cutting edge. When the razor head is moved from the neutral position to a specified movement position, the clearance at the position separated from the cutting edge is less than the clearance at a position in the vicinity of the cutting edge.

27 Claims, 6 Drawing Sheets

(56) References Cited

U.S. PATENT DOCUMENTS

| | | | | |
|---|---|---|---|---|
| 5,093,991 | A | 3/1992 | Hendrickson | |
| 6,223,442 | B1 | 5/2001 | Pina | |
| 6,308,416 | B1 | 10/2001 | Bosy et al. | |
| 6,880,253 | B1 | 4/2005 | Gyllerstrom | |
| 7,086,160 | B2 * | 8/2006 | Coffin | B26B 21/222 30/50 |
| 7,877,879 | B2 * | 2/2011 | Nakasuka | B26B 21/44 30/41 |
| 7,975,389 | B2 * | 7/2011 | Bozikis | B26B 21/522 30/32 |
| D651,345 | S * | 12/2011 | Micinilio | D28/48 |
| 8,104,179 | B2 * | 1/2012 | Nakasuka | B26B 21/227 30/50 |
| D699,396 | S * | 2/2014 | Hasegawa | D28/48 |
| 9,498,892 | B2 * | 11/2016 | Gordon | B26B 21/225 |
| 2003/0213130 | A1 | 11/2003 | Motta | |
| 2004/0055159 | A1 | 3/2004 | Khomari | |
| 2006/0123631 | A1 | 6/2006 | Szczepanowski et al. | |
| 2008/0189964 | A1 * | 8/2008 | Bozikis | B26B 21/522 30/526 |
| 2009/0313837 | A1 * | 12/2009 | Winter | B26B 21/521 30/527 |
| 2010/0281694 | A1 | 11/2010 | Royle | |
| 2014/0150264 | A1 * | 6/2014 | Micinilio | B26B 21/522 30/41 |
| 2015/0273708 | A1 * | 10/2015 | Haba | B26B 21/225 30/41 |
| 2015/0290820 | A1 * | 10/2015 | Haba | B26B 21/4012 30/41 |
| 2015/0290822 | A1 * | 10/2015 | Haba | B26B 21/225 30/526 |

FOREIGN PATENT DOCUMENTS

| | | | |
|---|---|---|---|
| CN | 101080308 | A | 11/2007 |
| CN | 101237969 | A | 8/2008 |
| DE | 10 2009 050344 | A1 | 5/2011 |
| EP | 2 711 146 | A1 * | 3/2014 |
| GB | 2 030 909 | A | 4/1980 |
| JP | 6269980 | B | 5/1987 |
| JP | 63143276 | B | 9/1988 |
| JP | 02280789 | | 11/1990 |
| JP | 05212165 | B | 8/1993 |
| JP | 2002533190 | A | 10/2002 |
| JP | 2009178365 | B | 8/2009 |
| KR | 101082303 | B1 | 11/2011 |
| WO | 2012005839 | A2 | 12/2012 |

OTHER PUBLICATIONS

European Search Report for Application No. 13853531.5 dated Jun. 9, 2016.

International Preliminary Report on Patentability for PCT/JP2013/079813, dated Jan. 21, 2014, pp. 1-7.

International Search Report for PCT/JP2013/079813, dated Jan. 21, 2014, pp. 1-4.

* cited by examiner

RAZOR

RELATED APPLICATIONS

The present invention is a U.S. National Stage under 35 USC 371 patent application, claiming priority to Serial No. PCT/JP2013/079813, filed on 5 Nov. 2013; which claims priority from Japanese Patent Application No. 2012-244029, filed 6 Nov. 2012, the entirety of both of which are incorporated herein by reference.

BACKGROUND OF THE INVENTION

The present invention relates to a razor including a razor head attached to a top portion of a holder.

In a razor described in Patent Document 1, the cutting edge of a blade body incorporated in a razor head is exposed on the front side of the razor head. The razor head is detachably supported on the upper end of a top portion of the holder on the back side of the razor head by a predetermined support structure.

PRIOR ART DOCUMENTS

Patent Documents

Patent Document 1: Japanese Laid-Open Patent Publication No. 5-212165

SUMMARY OF THE INVENTION

When the razor described in Patent Document 1 is used to shave skin hairs (body hairs) grown on various areas on a body, the top portion of the holder needs to be perpendicularly applied to the skin surface in order to move the front side of the razor head along the skin surface of the body. Thus, the hand holding the holder has to be largely bent, which reduces usability of the razor.

It is an objective of the present invention to improve usability of a razor in shaving skin hairs grown on various areas on the body.

To achieve the foregoing objective and in accordance with one aspect of the present invention, a razor is provided that includes a holder including a handle and a top portion at an upper end of the handle and a razor head including a blade body attached to a front of the top portion of the holder. The razor head has a front side on which a cutting edge of the blade body is exposed, and a back side opposite to the front side. The razor head is located to face the top portion with a clearance between the back side of the razor head and the front of the top portion.

Thus, for shaving skin hairs grown on various areas on the body, the razor can be used by moving the front side of the razor head along the skin surface of the body even without largely bending the hand holding the holder. Also, the clearance between the back side of the razor head and the front of the top portion restrains the front of the top portion from coming into contact with the skin surface of the body when the razor is used by moving the front side of the razor head along the skin surface of the body. This improves usability of the razor.

A pivoting mechanism that moves the razor head from a neutral position toward the front of the top portion is preferably provided in the top portion of the holder. At the neutral position of the razor head, the clearance between the back side of the razor head and the front of the top portion is preferably set to increase upward from a vicinity of the cutting edge. In this case, the pivoting range of the razor head is increased on a side opposite to the cutting edge, thereby improving usability of the razor.

A pivoting mechanism that moves the razor head from a neutral position toward the front of the top portion is preferably provided in the top portion of the holder, and the top portion preferably extends upward from the upper end of the handle while being bent from the front to a back. In this case, the clearance at a position spaced apart from the cutting edge is easily set to be larger than the clearance between the back side of the razor head and the front of the top portion near the cutting edge of the blade body, and the pivoting range of the razor head at the position spaced apart from the cutting edge is increased, thereby improving usability of the razor.

A pivoting mechanism that moves the razor head from a neutral position toward the front of the top portion is preferably provided in the top portion of the holder. The pivoting mechanism configured such that: the clearance between the back side of the razor head and the front of the top portion is changeable; at the neutral position of the razor head, the clearance between the back side of the razor head and the front of the top portion increases upward from below in a vicinity of the cutting edge; the razor head is movable from the neutral position to a specified movement position; and at the specified movement position, the clearance decreases upward from below in a vicinity of the cutting edge.

In this case, when the razor head is moved from the neutral position to the movement position, the pivoting range of the razor head at the position spaced apart from the cutting edge is increased, thereby improving usability of the razor.

The top portion of the holder is preferably configured to expand from the upper end of the handle to left and right of the cutting edge of the blade body. In this case, the front of the top portion of the holder is widened, and thus the razor head is easily attached to the top portion of the holder.

In the holder, the handle preferably extends to be bent downward from the back to the front when viewed from the side in a middle portion between the upper end and a lower end. In this case, the front of the handle is recessed in the middle portion of the handle, and thus the handle is easily held in use, thereby improving usability of the razor.

The pivoting mechanism preferably includes a support portion provided in the top portion of the holder, a supported portion provided in the razor head, and an elastic portion provided between the support portion and the supported portion. The razor head is preferably capable of taking the neutral position, where the razor head holds as a result of being pushed by the elastic portion, and a movement position to which the razor head is moved from the neutral position against a pushing force of the elastic portion. In this case, the razor head is supported by the elastic portion, and thus the support structure that movably supports the razor head from the neutral position against elasticity is simplified.

The elastic portion is preferably an elastic plate, has an outer periphery supported by the support portion of the top portion, and supports the supported portion of the razor head at a position inside the outer periphery of the elastic plate. In this case, the inside of the outer periphery of the elastic plate is easily bent. Also, the outer periphery of the elastic plate is supported by the support portion of the top portion, and thus the inside of the outer periphery of the elastic plate can be bent. Further, the inside of the elastic plate, which is easily bent, supports the supported portion, thereby allowing the razor head to be easily moved against the elasticity of the elastic plate and returned to the neutral position.

The support portion of the top portion preferably includes an annular portion that is annularly provided, and a support hole is preferably located between an inner periphery of the annular portion of the support portion and an outer periphery of the supported portion of the razor head. The elastic portion preferably has an annular portion annularly provided in the support hole. Also, the top portion is preferably curved to expand from the back to the front, and the annular portion of the elastic portion is preferably curved along the top portion.

In this case, the annular portion of the elastic portion is bent in the support hole. Also, the top portion is curved to expand from the back to the front, and the annular portion of the elastic portion is curved along the top portion, thereby allowing the elastic portion to be easily attached to the inside of the top portion.

The annular portion of the support portion of the top portion need not be annularly continuous, but a plurality of support portions may be provided and annularly intermittently provided. The annular portion of the elastic portion need not be annularly continuous either, but a plurality of independent elastic portions may be provided and annularly intermittently provided.

The elastic portion preferably includes a flexible portion, and the flexible portion preferably includes a plurality of sections having different deformation resistances that indicate resistances against deformation. In this case, a deformation resistance of the elastic portion is changed according to the pivoting direction of the razor head to change shaving sensation.

The flexible portion of the elastic portion preferably includes an upper section and a lower section located to face each other in a direction perpendicular to an extending direction of the cutting edge of the blade body, and a deformation resistance of the lower section is preferably set to be higher than that of the upper section. In this case, when the razor head is pivoted toward the top portion of the holder at the neutral position, the pivoting force is mainly applied to the upper section located opposite to the cutting edge, which allows the razor head to be easily pivoted toward the top portion. Also, when the razor head is pivoted apart from the top portion of the holder at the neutral position, a pivoting force is mainly applied to the lower section near the cutting edge, which makes it difficult to pivot the razor head apart from the top portion. This allows the razor head to be easily pivoted in an adequate direction.

At the neutral position of the razor head, the elastic portion is preferably located in the support hole between the annular portion of the support portion and the supported portion of the razor head, and the razor head preferably includes an attachment portion that incorporates the blade body. Also, the supported portion of the razor head preferably includes a first coupling portion that holds the elastic portion between the supported portion and the support portion of the top portion, a second coupling portion extending from the attachment portion, and a joint portion that supports the first and second coupling portions. Further, an end of the first coupling portion located on a side opposite to the attachment portion is preferably located in the support hole at the neutral position of the razor head.

In this case, at the neutral position of the razor head, the user is prevented from accidentally touching the elastic portion located in the support hole in use to interfere with pivoting of the razor head, thereby improving usability of the razor. Also, the user is prevented from accidentally touching the second coupling portion in the supported portion of the razor head in use to interfere with pivoting of the razor head, thereby improving usability of the razor.

When the holder is placed on a placement surface with the razor head being located at the neutral position, an inclination angle between the front surface of the razor head and the placement surface is preferably set to 20 degrees or more, and the razor head is preferably configured to abut against the top portion to stop at the movement position to which the razor head has been moved from the neutral position toward the front of the top portion.

In this case, the surface of the razor head is restrained from coming into contact with the placement surface when the holder is held and raised from the placement surface.

The razor head is preferably located apart from the placement surface when the holder is placed on the placement surface with the razor head being located at the neutral position. In this case, the surface of the razor head along the skin surface of the body is less likely to be soiled.

The pivoting mechanism is preferably configured such that the razor head is moved by 30 degrees or more from the neutral position toward the front of the top portion and abuts against the top portion to stop. In this case, the pivoting range of the razor head may be increased to improve usability of the razor.

A bending angle of the top portion with respect to the upper end when viewed from the side of the handle is preferably larger than that in the middle portion of the handle. In this case, the handle is easily held even if the top portion is bent.

The top portion is preferably curved to expand from the back toward the front when viewed from the side, and the handle is preferably curved to expand from the front toward the back when viewed from the side. Also, the entire holder is preferably curved into an S shape when viewed from the side. In this case, the handle is easily held even if the top portion is curved.

The elastic portion preferably has an outer periphery supported by the support portion of the top portion. In this case, the outer periphery of the elastic portion is supported by the support portion of the top portion, thereby allowing the inside of the elastic portion rather than the outer periphery thereof to be bent.

The elastic portion preferably supports the supported portion of the razor head at a position inside the outer periphery of the elastic portion. In this case, the supported portion is supported on the inside, which is more easily bent than the outer periphery in the elastic portion, thereby allowing the razor head to be easily moved against the elasticity and easily returned to the neutral position.

The elastic portion preferably includes an elastic plate. In this case, the elastic portion is in a form of the plate, thereby allowing the inside of the outer periphery to be easily bent.

The supported portion of the razor head is preferably supported by at least one of a front side and a back side of the elastic plate. In this case, the razor head is easily moved against the elasticity of the elastic plate and easily returned to the neutral position.

The support portion of the top portion preferably has an annular portion, and a support hole is preferably located between an inner periphery of the annular portion of the support portion and an outer periphery of the supported portion of the razor head. Also, the elastic portion preferably has an annular portion annularly provided in the support hole. The annular portion of the support portion of the top portion may be annularly continuous, and also a plurality of support portions may be annularly intermittently provided.

The annular portion of the elastic portion may be annularly continuous, and also a plurality of elastic portions may be annularly intermittently provided. In this case, the annular portion of the elastic portion may be bent in the support hole.

The top portion is preferably curved to expand from the back toward the front, and the elastic portion is preferably curved along the top portion. In this case, the elastic portion is easily attached to the inside of the top portion.

The sections of the flexible portion in the elastic portion are preferably arranged adjacent to each other. In this case, the elastic portion including the plurality of sections with different deformation resistances in one flexible portion is easily provided.

The sections of the flexible portion in the elastic portion are preferably annularly arranged on the outer periphery of the supported portion of the razor head. In this case, the elastic portion including the plurality of sections with different deformation resistances in the flexible portion is easily provided.

The flexible portion of the elastic portion is preferably deformed with movement of the razor head from the neutral position to the movement position, and a deformation resistance at the movement position of the flexible portion is preferably set to be higher than that at the neutral position of the flexible portion. In this case, a soft shaving sensation may be provided at the beginning of a pivoting action of the razor head, and also the razor head may be stabilized at the end of the pivoting action, thereby improving shaving sensation.

The top portion is preferably provided continuously with the handle in the holder, and the handle preferably includes a finger contact portion that is molded integrally with the elastic portion of the top portion and exposed. In this case, the holder including the elastic portion and the finger contact portion is easily molded.

The elastic portion is preferably located in the support hole between the annular portion of the support portion and the supported portion of the razor head with the razor head being located at the neutral position. In this case, a user is prevented from accidentally touching the elastic portion in use of the razor to interfere with the pivoting action of the razor head, thereby improving usability of the razor.

The present invention improves usability of the razor in shaving skin hairs grown on various areas on the body.

DETAILED DESCRIPTION OF THE PREFERRED EMBODIMENTS

A pivoting razor according to one embodiment of the present invention will now be described with reference to the drawings.

Figure 1A:
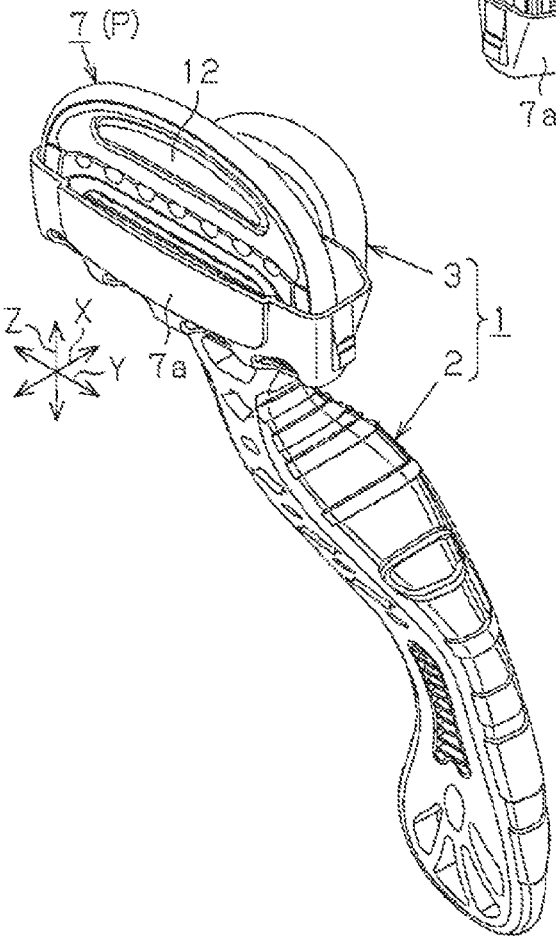
FIG. 1A is an overall front perspective view of a pivoting razor with a cap fitted thereon at a neutral position of a razor head.
Figure 1B:
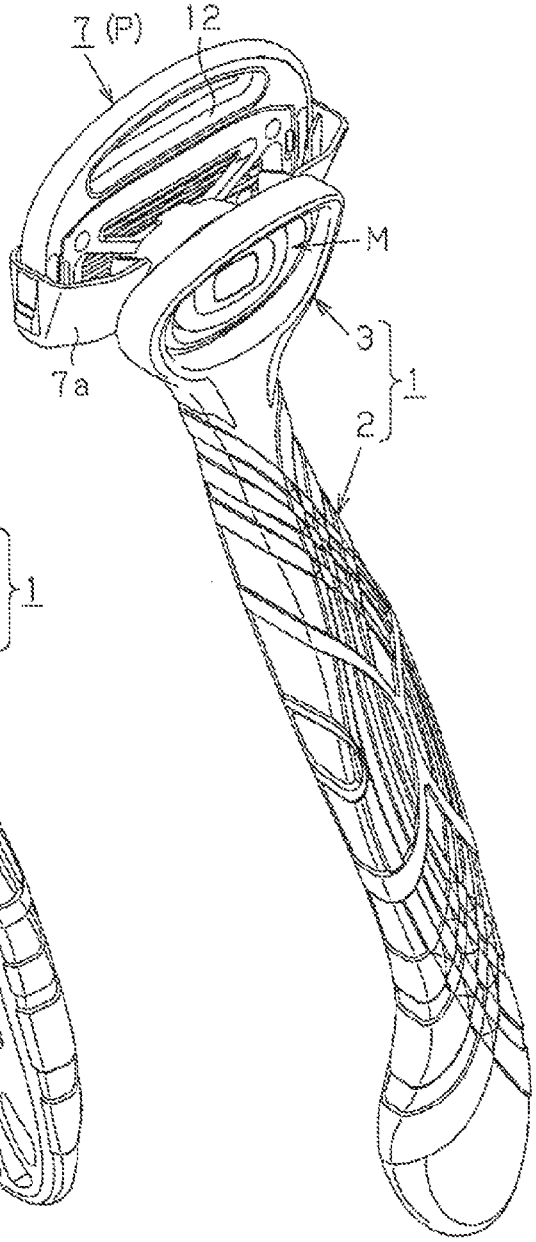
FIG. 1B is an overall rear perspective view of the pivoting razor in FIG. 1A.
Figure 2A:
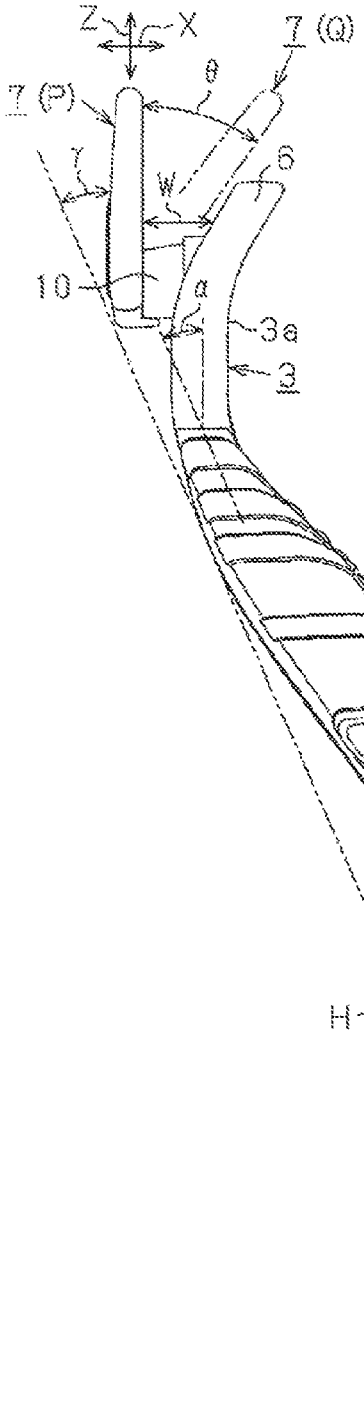
FIG. 2A is an overall side view of the pivoting razor in FIGS. 1A and 1B with the cap removed.
Figure 2B:
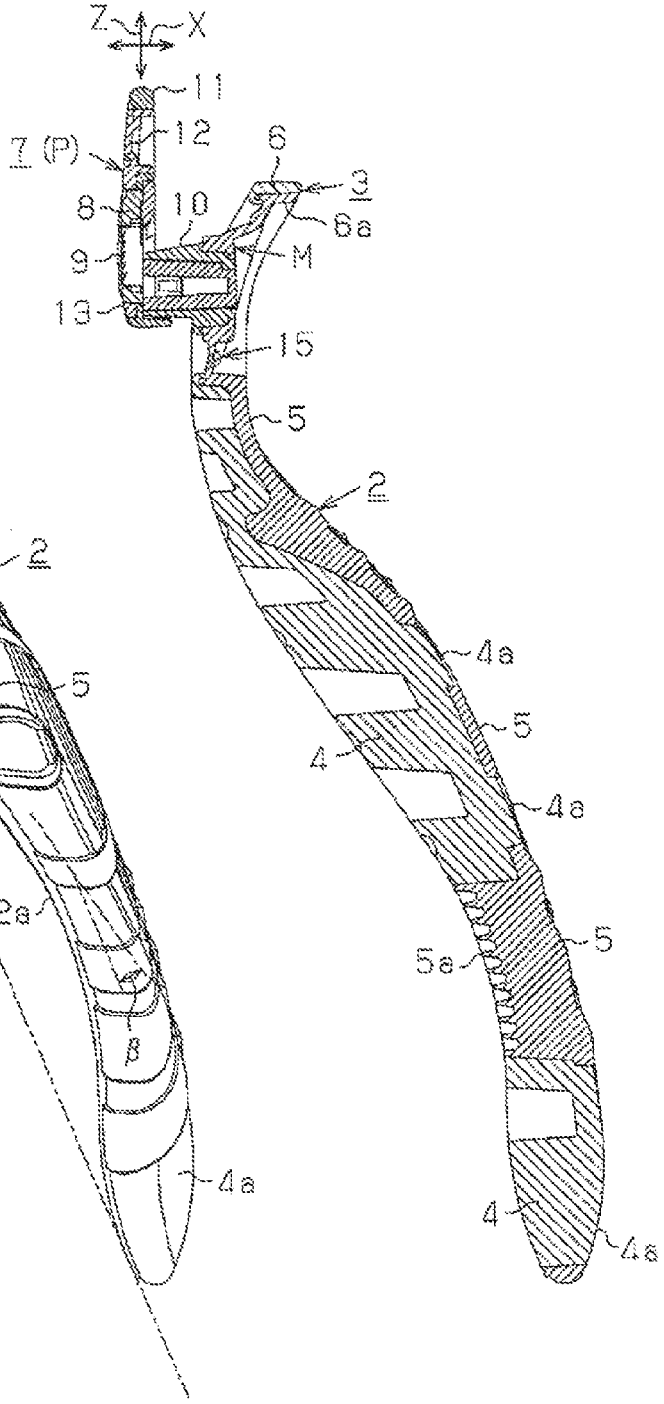
FIG. 2B is an overall cross-sectional side view of the pivoting razor in FIGS. 1A and 1B.
Figure 3A:
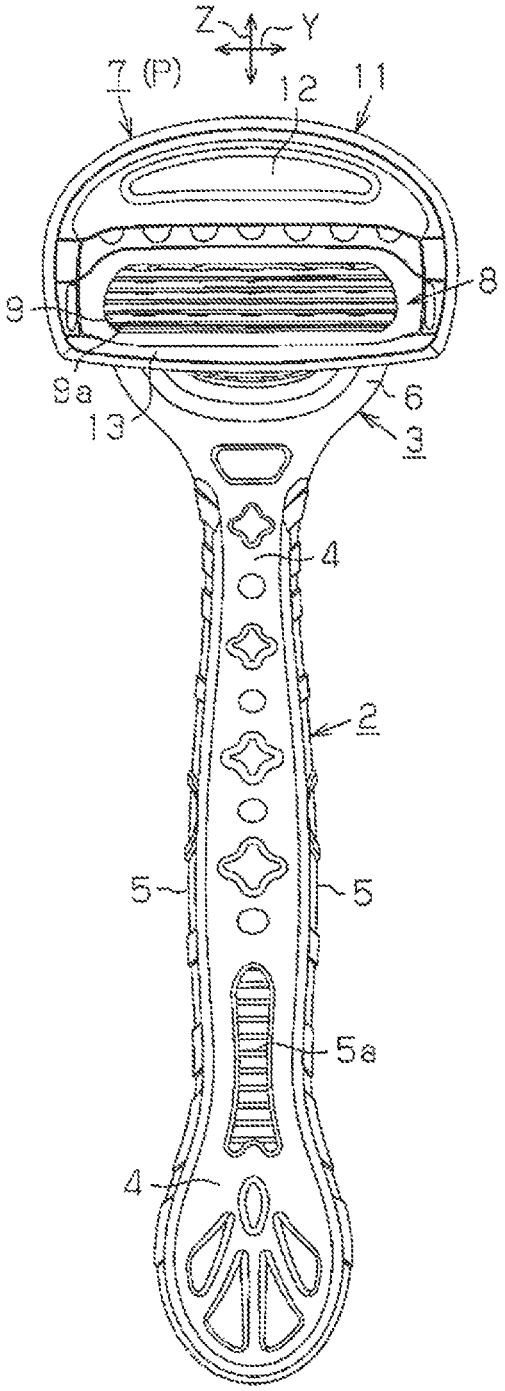
FIG. 3A is an overall front view of the pivoting razor in FIGS. 1A and 1B with the cap removed.
Figure 3B:
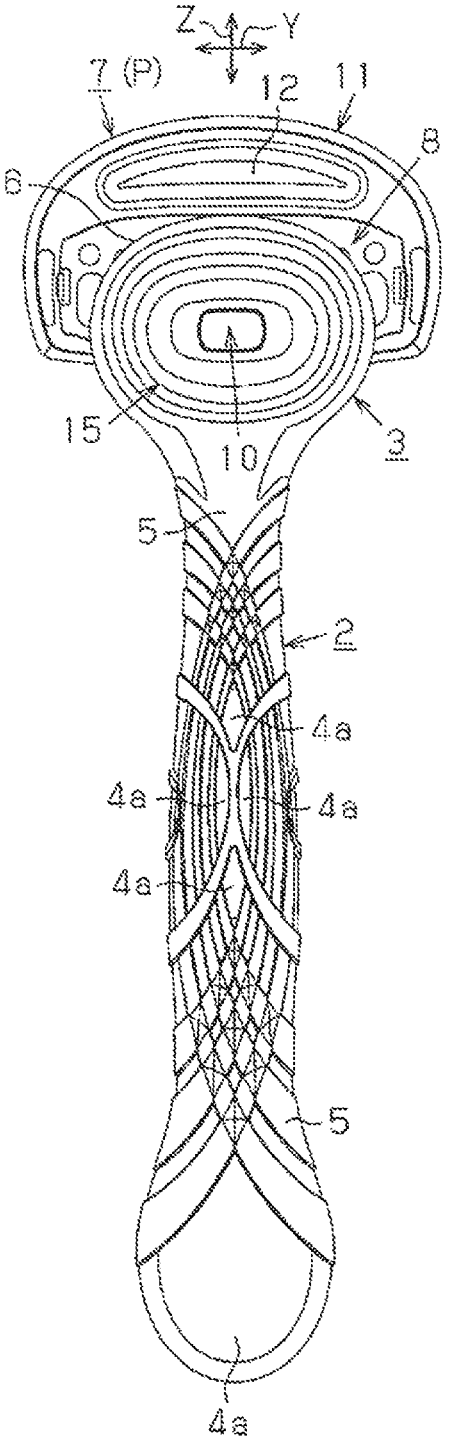
FIG. 3B is an overall rear view of the pivoting razor in FIGS. 1A and 1B.

A holder 1 shown in FIGS. 1A and 1B includes an elongated handle 2 extending in a vertical direction Z and a top portion 3 provided at the upper end of the handle 2. As shown in FIGS. 2A and 2B, the handle 2 includes a main body 4 molded of hard plastic, and a finger contact portion 5 molded of soft plastic, rubber, or a soft material other than rubber, and exposed on the outside of the main body 4. As shown in FIG. 3A, the main body 4 is exposed on substantially the entire region of the front of the handle 2, and a part 5*a* of the finger contact portion 5 is exposed on the lower part of the front. As shown in FIG. 3B, the finger contact portion 5 is exposed on substantially the entire region of the back of the handle 2, and a part 4*a* of the main body 4 is exposed on a middle portion and a lower end of the back. As shown in FIG. 2A, the finger contact portion 5 is exposed on substantially the entire region of a side of the handle 2, and the part 4*a* of the main body 4 is exposed on a lower end of the side. The top portion 3 includes a support portion 6 molded of hard plastic along with the main body 4 of the handle 2 integrally with the main body 4. The support portion 6 is continuous with the main body 4 at the upper end of the handle 2 and expands to the left and right.

Figure 4:
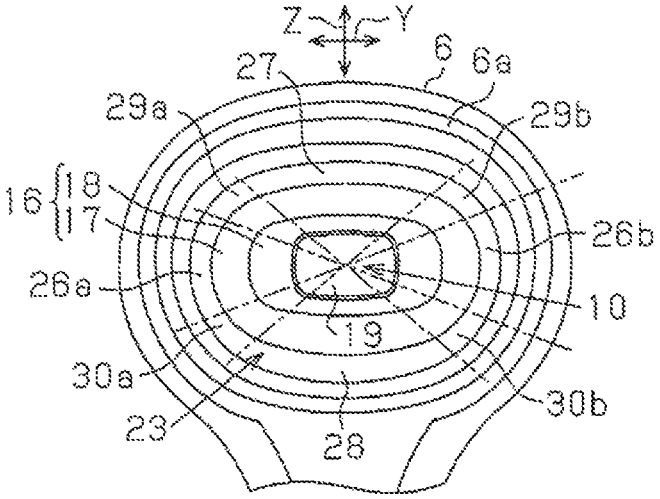
FIG. 4 is a partially enlarged back view of a top portion of a holder in the pivoting razor in FIGS. 3A and 3B.
Figure 5:
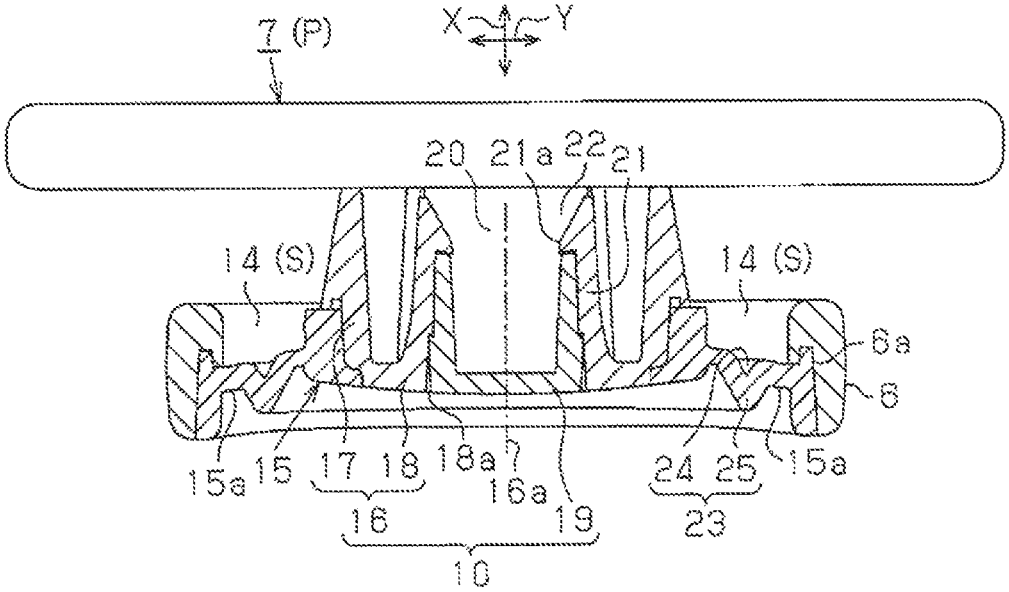
FIG. 5 is a partially enlarged cross-sectional view of the pivoting razor in FIG. 3B.
Figure 6:
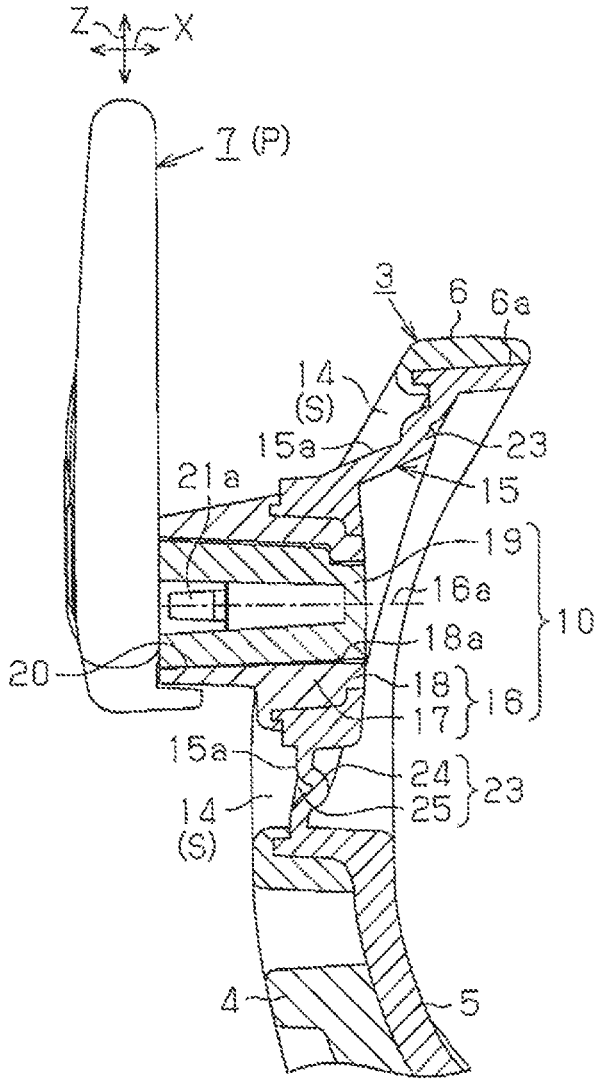
FIG. 6 is a partially enlarged vertical cross-sectional view of the pivoting razor in FIG. 3B.

As is apparent from FIGS. 4, 5 and 6, an annular portion 6*a* having a substantially rectangular annular shape with an upper side, a lower side, a left side, and a right side is provided in the support portion 6 of the top portion 3. The upper side, the lower side, the left side, and the right side are provided along gentle curves expanding outward, and a corner between the upper side and the left side, a corner between the upper side and the right side, a corner between the lower side and the left side, and a corner between the lower side and the right side also expand outward along gentle curves to be smoothly continuous with the upper side, the lower side, the left side, and the right side. The maximum clearance between the left side and the right side inside the upper side and the lower side is set to about 28 mm, and the maximum clearance between the upper side and the lower side inside the left side and the right side is set to about 23 mm.

As shown in FIG. 2A, a razor head 7 in FIGS. 1A and 1B is attached to the front of the top portion 3 with a clearance W therebetween by a pivoting mechanism M. A cap 7*a* is detachably fitted upward on the lower side of the razor head 7 from below.

As shown in FIGS. 2B, 3A and 3B, the razor head 7 includes a blade body attachment portion 8 to which a blade body 9 is attached, a supported portion 10 extending from the back side of the blade body attachment portion 8 toward the support portion 6 of the top portion 3, and a frame 11, to which the blade body attachment portion 8 is fitted and which surrounds the outer periphery of the blade body attachment portion 8 on top, bottom, left and right sides. A cutting edge 9*a* of the blade body 9 is exposed on the front side of the blade body attachment portion 8. Shaving aids 12, 13 are provided on the upper and lower sides, respectively, of the frame 11.

As shown in FIGS. 2A, 2B, and 4 to 6, an elastic plate 15 (elastic portion) is provided as a pivoting mechanism M in a support hole 14 between the inner periphery of the annular portion 6*a* of the support portion 6 of the top portion 3 and the outer periphery of the supported portion 10 of the razor head 7. The top of the annular portion 6*a* of the support portion 6 is located substantially at the same height as the upper end of the blade body attachment portion 8 of the razor head 7 in the vertical direction Z, and the top of the frame 11 protrudes upward from the top of the annular portion 6*a*.

The supported portion 10 of the razor head 7 includes a first coupling portion 16, which has a cylindrical portion 17 and a bottom 18, and a second coupling portion 19, which protrudes from the blade body attachment portion 8. The cylindrical portion 17 of the first coupling portion 16 has a rectangular cylindrical shape with an upper wall, a lower wall, a left wall, and a right wall. The second coupling portion 19 also has a closed rectangular cylindrical shape by an upper wall, a lower wall, a left wall, a right wall, and the bottom 18. As shown in FIG. 5, a coupling hole 20 opening toward the blade body attachment portion 8 of the razor head 7 is provided in the first coupling portion 16, and the coupling hole 20 is opened in the bottom 18 by a window 18*a*. The bottom 18 has left and right cantilever locking arms 21 extending in a front-back direction X from the window 18*a* toward the blade body attachment portion 8. Left and right walls of the second coupling portion 19 have locking holes 22. An outside dimension of the cylindrical portion 17 of the first coupling portion 16 in a lateral direction Y is set to about 19 mm, and an outside dimension of the cylindrical portion 17 of the first coupling portion 16 in the vertical direction Z is set to about 12 mm.

The second coupling portion 19 is inserted into the coupling hole 20 in the first coupling portion 16. In the insertion state, the second coupling portion 19 is guided only along an axis 16*a* in the extending direction of the cylindrical portion 17 without being pivoted around the axis 16*a*, and inserted into the coupling hole 20 in the first coupling portion 16, that is, a joint portion. The bottom of the second coupling portion 19 is abutted against the bottom 18 of the first coupling portion 16 and restricted from moving in the front-back direction X, and exposed from the window 18*a* of the bottom 18 to be substantially flush with the bottom 18. The left and right locking arms 21 of the first coupling portion 16, which serve as joint portions, are locked into the left and right locking holes 22 of the second coupling portion 19, which also serve as joint portions, via locking hooks 21*a*. This prevents the second coupling portion 19 from being accidentally disengaged from the first coupling portion 16. Thus, the first coupling portion 16 and the second coupling portion 19 cannot be detached from each other. The first coupling portion 16 and the second coupling portion 19 may be configured to be detachable from each other. The cylindrical portion 17 and the bottom 18 of the first coupling portion 16, and the left and right locking arms 21 of the first coupling portion 16 are also molded of hard plastic.

The elastic plate 15 is molded integrally with the finger contact portion 5 by supplying the same material as that for the finger contact portion 5 (soft plastic, rubber or a soft material other than rubber) into a cavity in a mold into which the support portion 6 of the top portion 3 and the first coupling portion 16 of the supported portion 10 in the razor head 7 are inserted. The elastic plate 15 includes an annular portion 15*a* annularly continuous along the inner periphery of the annular portion 6*a* of the support portion 6 and the outer periphery of the cylindrical portion 17 of the coupling portion 16 in the support hole 14. The finger contact portion 5 has irregularities of various shapes for providing slip resistance and a tactile sensation. For example, the elastic plate 15 and the finger contact portion 5 are molded of styrene thermoplastic elastomer, which has a Shore A hardness of 20 to 60.

After such an elastic plate 15 is molded, the blade body attachment portion 8 is inserted into the supported portion 10 as described above. The outer periphery of the annular portion 15*a* is in surface contact with the inner periphery of the annular portion 6*a* of the support portion 6, and attached to the annular portion 6*a* by heat or pressure in molding. The supported portion 10 is supported between the front side and the back side of the annular portion 15*a* while extending through the annular portion 15*a* in the thickness direction (front-back direction X). The inner periphery of the annular portion 15*a* is in surface contact with the outer periphery of the cylindrical portion 17 of the supported portion 10, and attached to the supported portion 10 by heat or pressure in molding. The annular portion 15*a* has a flexible portion 23. The flexible portion 23 includes a rib 24 annularly continuously extending around the axis 16*a* in the extending direction of the cylindrical portion 17, and a groove 25 annularly continuously extending inside the rib 24. The elastic plate 15 is located in an inner region S partitioned by front and back inner peripheral edges of the annular portion 6*a* in the support hole 14 between the annular portion 6*a* of the support portion 6 and the supported portion 10 of the razor head 7. In the supported portion 10 of the razor head 7, the bottom 18 of the first coupling portion 16 and the bottom of the second coupling portion 19 are located in the inner region S of the support hole 14 on the side opposite to the blade body attachment portion 8.

The rib 24 of the flexible portion 23 protrudes along the axis 16*a* away from the blade body attachment portion 8, but may protrude along the axis 16*a* toward the blade body attachment portion 8. The elastic plate 15, which includes the annular portion 15*a*, has a substantially uniform thickness (0.1 to 3 mm). In the annular portion 15*a* of the elastic plate 15, the thickness of the flexible portion 23 may be smaller than that of portions other than the flexible portion 23 so that the flexible portion 23 is easily bent. In the flexible portion 23, a dimension of protrusion of the rib 24 is 0.3 to 5 mm.

As partitioned by long dashed double-short dashed lines in FIG. 4, the flexible portion 23 in the elastic plate 15 includes a left first section 26*a* and a right second section 26*b* arranged to face each other in the extending direction of the cutting edge 9*a* of the blade body 9 in the razor head 7, that is, in the lateral direction Z, an upper third section 27 and a lower fourth section 28 arranged to face each other in the vertical direction Z perpendicular to the extending direction of the cutting edge 9*a*, fifth sections 29*a*, 29*b* located between the upper third section 27 and the first and second sections 26*a*, 26*b* on the left and right sides, and sixth sections 30*a*, 30*b* located between the lower fourth section 28 and the first and second sections 26*a*, 26*b* on the left and right sides.

In the support hole 14, the inner peripheral shape of the annular portion 6*a* of the support portion 6 and the outer peripheral shape of the first coupling portion 16 of the supported portion 10 are substantially similar to each other. The clearance (about 6 mm) between the upper side of the support portion 6 and the upper wall of the first coupling portion 16 is set larger than the clearance (about 4 mm) between the lower side of the support portion 6 and the lower wall of the first coupling portion 16. The clearance (about 4 mm) between the left side of the support portion 6 and the left wall of the first coupling portion 16 and the clearance (about 4 mm) between the right side of the support portion 6 and the right wall of the first coupling portion 16 are set substantially equal to each other. The sections 26*a*, 26*b*, 27, 28, 29*a*, 29*b*, 30*a*, 30*b* of the flexible portion 23 are provided adjacent to each other and integrally formed. The sections 26*a*, 26*b*, 27, 28, 29*a*, 29*b*, 30*a*, 30*b* may be independently formed.

As shown in FIG. 2A, in the holder 1, the top portion 3 extends to be bent upward from the upper end of the handle 2 from the front toward the back when viewed from the side. The top portion 3 is curved to expand from the back toward the front, and the handle 2 extends to be bent downward from the back toward the front and is curved to expand from the front toward the back in the middle portion between the upper end and the lower end. Thus, the back of the top portion 3 has a recess 3*a* when viewed from the side, the front of the handle 2 has a recess 2*a* when viewed from the side, and with the recesses 3*a*, 2*a*, the entire holder 1 is curved into a smoothly continuous S shape when viewed from the side. A bending angle α (15 to 60 degrees) of the top portion 3 with respect to the upper end of the handle 2 when viewed from side is set to be larger than a bending angle β (5 to 45 degrees) in the middle portion of the handle 2. The elastic plate 15 is curved along the top portion 3.

Since the elastic plate 15 of the top portion 3 is curved as described above, the elastic plate 15 has different cross-sectional forms or lengths in the sections 26*a*, 26*b*, 27, 28, 29*a*, 29*b*, 30*a*, 30*b* of the flexible portion 23 in the elastic plate 15. Thus, deformation resistances (degree of elasticity), which indicate resistance against deformation, of the sections 26*a*, 26*b*, 27, 28, 29*a*, 29*b*, 30*a*, 30*b* of the flexible portion 23 in the elastic plate 15 are also different from each other as described below.

In the flexible portion 23 in the elastic plate 15, the first and second sections 26*a*, 26*b* on the left and right sides have the same deformation resistance, while the deformation resistance of the lower fourth section 28, which is close to the cutting edge 9*a*, is higher than that of the upper third section 27, which is far from the cutting edge 9*a*. The deformation resistance of the sixth sections 30*a*, 30*b* on left and right sides of the lower fourth section 28 is higher than that of the fifth sections 29*a*, 29*b* on left and right sides of the upper third section 27. Further, the deformation resistances of the fifth and sixth sections 29*a*, 29*b*, 30*a*, 30*b* are higher than those of the first and second sections 26*a*, 26*b* or the third and fourth sections 27, 28.

Next, operation of the pivoting razor, that is, a pivoting action in use of the razor will be described.

The razor head 7 is held at a neutral position P shown in FIGS. 2A, 2B and 4 to 6 by the elastic plate 15. At the neutral position P, the bottom 18 of the first coupling portion 16 and the bottom of the second coupling portion 19 in the supported portion 10 of the razor head 7 are located in the inner region S of the support hole 14 on the side opposite to the blade body attachment portion 8. The clearance W between the front of the top portion 3 and the back side of the razor head 7 increases upward from below in the vicinity of the cutting edge 9*a*.

If a force is applied to the blade body attachment portion 8 and the frame 11 of the razor head 7 at the neutral position P in use, the blade body attachment portion 8 and the supported portion 10 of the razor head 7 integrally move to press the elastic plate 15. The elastic plate 15 is bent in a plurality of directions to move the razor head 7. For example, the elastic plate 15 is bent in the vertical direction Z, the front-back direction X along the axis 16*a* of the cylindrical portion 17 of the supported portion 10, the lateral direction Y perpendicular to the axis 16*a*, a pivoting direction around the axis in the lateral direction Y, a pivoting direction around the axis in the vertical direction Z, and a direction of combination of the front-back direction X, the lateral direction Y, and the vertical direction Z. Thus, the razor head 7 is movable in any three-dimensional direction from the neutral position P to a plurality of movement positions against the elasticity of the elastic plate 15.

For example, if the razor head 7 is tilted upward or downward, the upper third section 27 and the lower fourth section 28 of the flexible portion 23 are mainly deformed. Also, for example, if the razor head 7 is pushed backward, the upper third section 27, the lower fourth section 28, the left first section 26*a*, and the right second section 26*b* of the flexible portion 23 are mainly deformed. Also, for example, if the razor head 7 is tilted to the right or left, the left first section 26*a* and the right second section 26*b* are mainly deformed. In those cases, the fifth and sixth sections 29*a*, 29*b*, 30*a*, 30*b* are less likely to be deformed than the third and fourth sections 27, 28 and the first and second sections 26*a*, 26*b*. Further, the forms of the sections 26*a*, 26*b*, 27, 28, 29*a*, 29*b*, 30*a*, 30*b* of the flexible portion 23 become forms less likely to be further deformed as deformation develops. Thus, the deformation resistances in the plurality of movement positions in the sections 26*a*, 26*b*, 27, 28, 29*a*, 29*b*, 30*a*, 30*b* of the flexible portion 23 are higher than that at the neutral position P. Also, the deformation resistances in the sections 26*a*, 26*b*, 27, 28, 29*a*, 29*b*, 30*a*, 30*b* of the flexible portion 23 become higher as the razor head 7 moves from the neutral position P toward the plurality of movement positions.

Figure 7A:
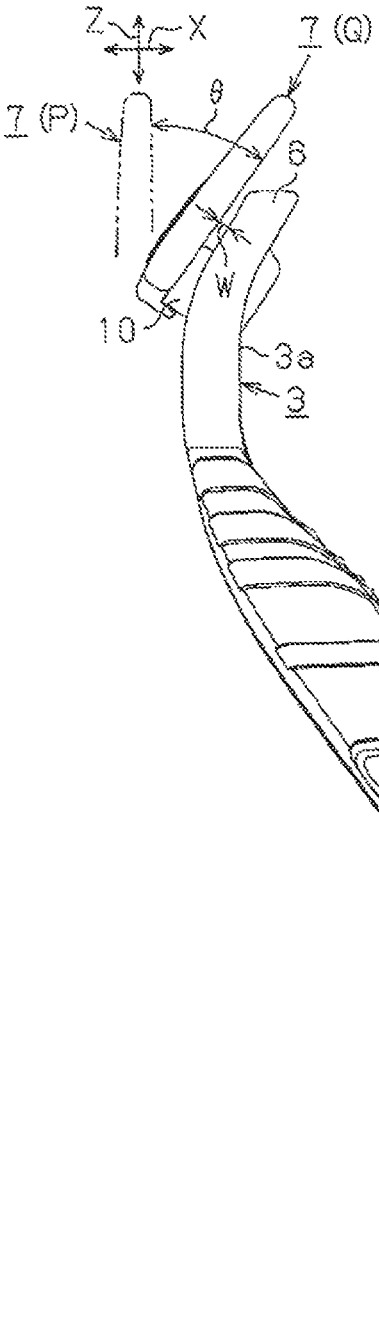
FIG. 7A is a general side view of a pivoting state of the razor head in the pivoting razor in FIG. 2A.

For example, FIG. 7A shows the razor head 7 having moved from the neutral position P shown by a long dashed double-short dashed line to a movement position Q shown by a solid line. If the back side of the razor head 7 moves by 30 degrees or more from the neutral position P toward the front of the top portion 3 and abuts against the front of the top portion 3, the razor head 7 is stopped at the movement position Q. The movement range therebetween is denoted by an angle θ. At the movement position Q, the clearance W between the front of the top portion 3 and the back side of the razor head 7 decreases upward from below in the vicinity of the cutting edge 9*a*, unlike at the neutral position P.

Using the razor while pressing the supported portion 10 and the elastic plate 15 from the back side of the top portion 3 with a finger prevents pivoting of the razor head 7 as intended by the user.

Figure 7B:
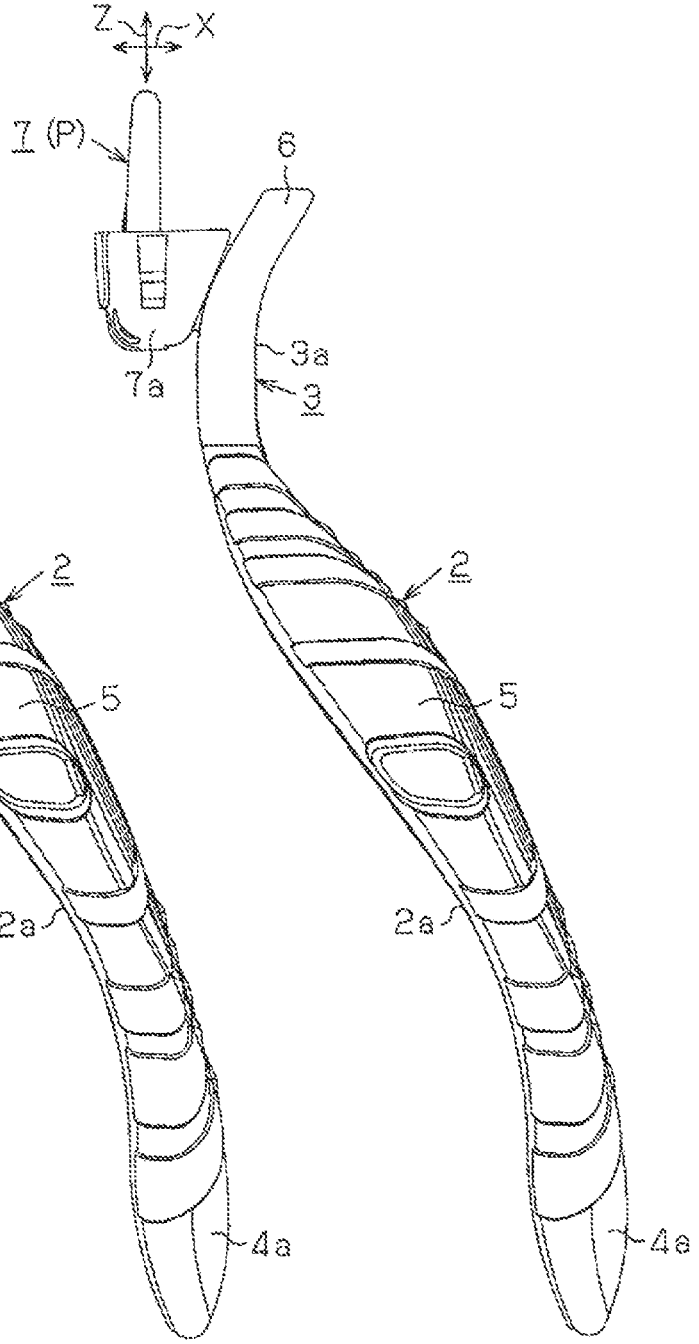
FIG. 7B is a general side view of the pivoting razor in FIGS. 1A and 1B.

As shown in FIG. 7B, when the razor head 7 is covered with the cap 7*a* from below, the razor head 7 moves only within a range of a gap between the cap 7*a* and the support portion 6 of the top portion 3. The movement range of the razor head 7 covered with the cap 7*a* is smaller than that of the razor head 7, which is not covered with the cap 7*a*. The cap 7*a* may cover the razor head 7 from above.

Also, as shown in FIG. 2A, when the handle 2 of the holder 1 is placed on a placement surface H with the razor head 7 arranged at the neutral position P, the surface of the razor head 7 is spaced apart from the placement surface H, and an angle γ between the razor head 7 and the placement surface H in that state is set to 20 degrees or more.

The present embodiment provides the following advantages.

(1) The back side of the razor head 7 is provided to face the front of the top portion 3 with the clearance W therebetween. Thus, for shaving skin hairs grown on various areas on the body, the razor can be used by moving the front side of the razor head 7 along the skin surface of the body without largely bending the hand holding the holder 1, thereby improving usability of the razor. Also, the clearance W provided between the back side of the razor head 7 and the front of the top portion 3 of the holder 1 prevents the front of the top portion 3 from coming into contact with the skin surface of the body when the razor is used by moving the front side of the razor head 7 along the skin surface of the body, thereby further improving usability of the razor.

(2) The top portion 3 of the holder 1 extends to be bent upward from the upper end of the handle 2 from the front to the back when viewed from the side. Thus, the clearance W between the back side of the razor head 7 and the front of the top portion 3 is easily set to increase upward from the cutting edge 9*a*. This increases the pivoting range of the razor head 7 above the cutting edge 9*a*, thereby improving usability of the razor.

(3) The clearance W between the front of the top portion 3 and the back side of the razor head 7 is changed by the pivoting mechanism M to increase upward from the cutting edge 9*a* at the neutral position P of the razor head 7, and decrease upward from below in the vicinity of the cutting edge 9*a* in the predetermined movement position Q, to which the razor head 7 is moved from the neutral position P. This increases the pivoting range of the razor head 7, thereby improving usability of the razor.

(4) Only the elastic plate 15 provided between the support portion 6 of the top portion 3 of the holder 1 and the supported portion 10 of the razor head 7 supports the razor head 7. This simplifies the support structure for supporting the razor head 7 movably from the neutral position P against the elasticity of the elastic plate 15.

(5) The simple support structure, in which the inner periphery of the annular portion 6*a* of the support portion 6 supports the outer periphery of the annular portion 15*a* of the elastic plate 15, and the supported portion 10 of the razor head 7 is inserted into the inner periphery of the annular portion 15*a* of the elastic plate 15, allows the razor head 7 to be moved from the neutral position P to the movement positions in any three-dimensional direction against the elasticity of the elastic plate 15, and also provides a cushioning function caused by the elasticity of the annular portion 15*a* of the elastic plate 15 in use of the razor head 7, thereby improving usability of the pivoting razor.

(6) The flexible portion 23, which includes the annular rib 24 and the groove 25, is provided in the annular portion 15*a* of the elastic plate 15. This allows the annular portion 15*a* of the elastic plate 15 to be easily bent in any three-dimensional direction, and further effectively provides a cushioning function caused by the flexible portion 23 in use of the razor head 7. Further, since the annular rib 24 protrudes along the axis 16*a* of the cylindrical portion 17 in the flexible portion 23, the annular portion 15*a* is more easily bent along the axis 16*a* (in the front-back direction X) than in the direction perpendicular to the axis 16*a* (the lateral direction Y or the vertical direction Z). Also, a function similar to that of a universal joint such as a ball joint is obtained around the intersection between an axis perpendicular to the axis 16*a* extending in the front-back direction X (an axis extending in the lateral direction Y or the vertical direction Z) and the axis 16*a*, thereby allowing the annular portion 15*a* to be more easily bent in the three-dimensional directions.

(7) In the annular portion 15*a* of the elastic plate 15, the flexible portion 23 having the annular rib 24 and the groove 25 has a substantially rectangular annular shape. This provides a function similar to that of a universal joint such as a ball joint, allows the deformation resistances of the fifth and sixth sections 29*a*, 29*b*, 30*a*, 30*b* of the flexible portion 23 to be higher than those of the first and second sections 26*a*, 26*b* or the third and fourth sections 27, 28, allows the deformation resistance of the fourth section 28 to be higher than that of the third section 27, and allows the deformation resistances to be higher as the razor head 7 moves from the neutral position P to the movement position, thereby allowing the deformation resistances thereof to be adequately set to easily change shaving sensation.

The above illustrated embodiment may be modified as follows.

In the above illustrated embodiment, the pivoting mechanism M may be omitted, and the razor head 7 may be supported by the top portion 3 of the holder 1 so as not to be pivotal.

Other than the elastic plate 15 molded of rubber, a foam material, a member containing a viscous material, a coil spring, or a leaf spring may be used as the elastic portion. Also, a spring molded of hard plastic or metal may be used.

The support portion 6 may have a triangular or elliptical annular shape other than the circular or rectangular annular shape. Other than the annular shape, the support portion 6 may have, for example, a U shape with a part cut away.

As the elastic portion, a plurality of through holes may be provided in the annular portion 15*a* of the elastic plate 15, and a plurality of flexible sections may be annularly arranged at regular intervals between the through holes. Also, for example, among the upper, lower, left and right positions of the elastic plate 15, the flexible sections may be provided in two upper and lower positions, two left and right positions, three left, right and upper positions, or three left, right, and lower positions.

The elastic portion may have a semi-spherical shape expanding on the support portion.

A portion corresponding to the elastic portion may be thin so as to be more easily bent.

In the annular elastic plate 15, the deformation resistance (degree of elasticity) indicating resistance against deformation may be changed around the elastic plate 15 by providing a varying thickness, changing the shape of the rib 24, or decentering the support position of the supported portion 10 on the elastic plate 15.

One or more thin plate portions may be provided between the support portion 6 of the top portion 3 and the supported portion 10 of the razor head 7 to restrict the annular portion 15*a* of the elastic plate 15 from being bent in the pivoting direction around the axis 16*a* in the front-back direction X. The thin plate portion allows the annular portion 15*a* of the elastic plate 15 to be bent in directions other than the pivoting direction around the axis 16*a* in the front-back direction X.

DESCRIPTION OF THE REFERENCE NUMERALS

1 holder
2 handle
3 top portion
6 support portion of top portion
6*a* annular portion of support portion
7 razor head

8 blade body attachment portion
9 blade body
9*a* cutting edge
10 supported portion of razor head
14 support hole in top portion
15 elastic plate of top portion (elastic portion)
15*a* annular portion of elastic plate
16, 19 first and second coupling portions of supported portion
20 coupling hole in supported portion (joint portion)
21 locking arm of supported portion (joint portion)
22 locking hole in supported portion (joint portion)
23 flexible portion of elastic plate
26*a* first section
26*b* second section
27 third section
28 fourth section
29*a*, 29*b* fifth section
30*a*, 30*b* sixth section
M pivoting mechanism
W clearance
P neutral position
Q movement position
Y extending direction of cutting edge (lateral direction)
Z vertical direction

The invention claimed is:

1. A razor comprising:

a holder including a handle and a top portion at an upper end of the handle; and a razor head including a blade body attached to a front of the top portion of the holder, wherein:

the razor head has a front side on which a cutting edge of the blade body is exposed, and a back side opposite to the front side; and the razor head is located to face the top portion with a clearance between the back side of the razor head and the front of the top portion, wherein the razor further comprises:

a pivoting structure that moves the razor head from a neutral position toward the front of the top portion is provided in the top portion of the holder, the pivoting structure includes a support portion provided in the top portion of the holder, a supported portion provided in the razor head, and an elastic portion provided between the support portion and the supported portion; and the razor head is capable of taking the neutral position, where the razor head holds as a result of being pushed by the elastic portion, and a movement position to which the razor head is moved from the neutral position against a pushing force of the elastic portion; and at the neutral position of the razor head, the clearance between the back side of the razor head and the front of the top portion is set to increase upward from a vicinity of the cutting edge.

2. The razor according to claim 1, wherein the top portion extends upward from the upper end of the handle while being bent from the front of the top portion to a back of the top portion.

3. The razor according to claim 1, wherein the pivoting structure is configured such that:

the clearance between the back side of the razor head and the front of the top portion is changeable;

at the neutral position of the razor head, the clearance between the back side of the razor head and the front of the top portion increases upward from below in a vicinity of the cutting edge;

the razor head is movable from the neutral position to the movement position; and at the movement position, the clearance decreases upward from below in a vicinity of the cutting edge.

4. The razor according to claim 1, wherein the top portion of the holder is configured to expand from the upper end of the handle to left and right of the cutting edge of the blade body.

5. The razor according to claim 1, wherein in the holder, the handle extends to be bent downward from a back of the handle to a front of the handle when viewed from a side of the handle in a middle portion between the upper end and a lower end of the handle.

6. The razor according to claim 5, wherein a bending angle of the top portion with respect to the upper end when viewed from the side of the handle is larger than that in the middle portion of the handle.

7. The razor according to claim 5, wherein the top portion is curved to expand from a back of the top portion toward the front of the top portion when viewed from the side of the handle;

the handle is curved to expand from the front of the handle toward the back of the handle when viewed from the side of the handle; and the entire holder is curved into an S shape when viewed from the side of the handle.

8. The razor according to claim 1, wherein the elastic portion is an elastic plate, has an outer periphery supported by the support portion of the top portion, and supports the supported portion of the razor head at a position inside the outer periphery of the elastic plate.

9. The razor according to claim 1, wherein the support portion of the top portion includes an annular portion that is annularly provided;

a support hole is located between an inner periphery of the annular portion of the support portion and an outer periphery of the supported portion of the razor head;

the elastic portion has an annular portion annularly provided in the support hole;

the top portion is curved to expand from a back of the top portion to the front of the top portion; and the annular portion of the elastic portion is curved along the top portion.

10. The razor according to claim 9, wherein at the neutral position of the razor head, the elastic portion is located in the support hole between the annular portion of the support portion and the supported portion of the razor head;

the razor head includes an attachment portion that incorporates the blade body;

the supported portion of the razor head includes a first coupling portion that holds the elastic portion between the supported portion and the support portion of the top portion, a second coupling portion extending from the attachment portion, and a joint portion that supports the first and second coupling portions; and an end of the first coupling portion located on a side opposite to the attachment portion is located in the support hole at the neutral position of the razor head.

11. The razor according to claim 1, wherein the elastic portion includes a flexible portion; and the flexible portion includes a plurality of sections having different deformation resistances that indicate resistances against deformation.

12. The razor according to claim 11, wherein the flexible portion of the elastic portion includes an upper section and a lower section located to face each other in a direction perpendicular to an extending direction of the cutting edge of the blade body; and a deformation resistance of the lower section is set to be higher than that of the upper section.

13. The razor according to claim 11, wherein the sections of the flexible portion in the elastic portion are arranged adjacent to each other.

14. The razor according to claim 13, wherein the sections of the flexible portion in the elastic portion are annularly arranged on the outer periphery of the supported portion of the razor head.

15. The razor according to claim 11, wherein the flexible portion of the elastic portion is deformed with movement of the razor head from the neutral position to the movement position; and a deformation resistance at the movement position of the flexible portion is set to be higher than that at the neutral position of the flexible portion.

16. The razor according to claim 1, wherein when the holder is placed on a placement surface with the razor head being located at the neutral position, an inclination angle between a front surface of the razor head and the placement surface is set to 20 degrees or more; and the razor head is configured to abut against the top portion to stop at the movement position to which the razor head has been moved from the neutral position toward the front of the top portion.

17. The razor according to claim 16, wherein the razor head is located apart from the placement surface when the holder is placed on the placement surface with the razor head being located at the neutral position.

18. The razor according to claim 16, wherein the pivoting structure is configured such that the razor head is moved by 30 degrees or more from the neutral position toward the front of the top portion and abuts against the top portion to stop.

19. The razor according to claim 1, wherein the elastic portion has an outer periphery supported by the support portion of the top portion.

20. The razor according to claim 19, wherein the elastic portion supports the supported portion of the razor head at a position inside the outer periphery of the elastic portion.

21. The razor according to claim 20, wherein the elastic portion includes an elastic plate.

22. The razor according to claim 21, wherein the supported portion of the razor head is supported by at least one of a front side and a back side of the elastic plate.

23. The razor according to claim 1, wherein the support portion of the top portion has an annular portion;

a support hole is located between an inner periphery of the annular portion of the support portion and an outer periphery of the supported portion of the razor head; and the elastic portion has an annular portion annularly provided in the support hole.

24. The razor according to claim 23, wherein the top portion is curved to expand from a back of the top portion toward the front of the top portion; and the elastic portion is curved along the top portion.

25. The razor according to claim 23, wherein the elastic portion is located in the support hole between the annular portion of the support portion and the supported portion of the razor head with the razor head being located at the neutral position.

26. The razor according to claim 25, wherein the razor head includes an attachment portion that incorporates the blade body;

the supported portion of the razor head includes a first coupling portion that holds the elastic portion between the supported portion and the support portion of the top portion, a second coupling portion extending from the attachment portion, and a joint portion that supports the first and second coupling portions; and an end of the first coupling portion located on a side opposite to the attachment portion is located in the support hole at the neutral position of the razor head.

27. The razor according to claim 1, wherein the top portion is provided continuously with the handle in the holder; and the handle includes a finger contact portion that is molded integrally with the elastic portion of the top portion and exposed.

* * * * *